US011164507B2

(12) United States Patent
Fang et al.

(10) Patent No.: US 11,164,507 B2
(45) Date of Patent: Nov. 2, 2021

(54) ELECTRONIC DEVICE FOR DRIVING DISPLAY PANEL AND OPERATION METHOD THEREOF

(71) Applicant: Novatek Microelectronics Corp., Hsinchu (TW)

(72) Inventors: Po-Hsiang Fang, Hsinchu (TW); Jhih-Siou Cheng, New Taipei (TW)

(73) Assignee: Novatek Microelectronics Corp., Hsinchu (TW)

( * ) Notice: Subject to any disclaimer, the term of this patent is extended or adjusted under 35 U.S.C. 154(b) by 0 days.

(21) Appl. No.: 16/809,478

(22) Filed: Mar. 4, 2020

(65) Prior Publication Data

US 2020/0202767 A1 Jun. 25, 2020

Related U.S. Application Data

(63) Continuation of application No. 15/976,830, filed on May 10, 2018, now Pat. No. 10,636,346.

(60) Provisional application No. 62/580,991, filed on Nov. 2, 2017.

(51) Int. Cl.
*G09G 3/20* (2006.01)

(52) U.S. Cl.
CPC ... *G09G 3/2092* (2013.01); *G09G 2300/0413* (2013.01); *G09G 2310/0264* (2013.01); *G09G 2310/0291* (2013.01); *G09G 2310/0294* (2013.01); *G09G 2310/0297* (2013.01); *G09G 2320/029* (2013.01); *G09G 2330/02* (2013.01)

(58) Field of Classification Search
CPC ..... G09G 3/2092; G09G 2300/0413; G09G 2300/02; G09G 2310/0291; G09G 2310/0294; G09G 2310/0297; G09G 3/20
See application file for complete search history.

(56) References Cited

U.S. PATENT DOCUMENTS

| | | | | |
|---|---|---|---|---|
| 9,218,768 | B2 * | 12/2015 | Lee | G09G 3/3291 |
| 9,619,083 | B1 * | 4/2017 | Kang | G09G 5/006 |
| 10,319,309 | B2 * | 6/2019 | Kim | G09G 3/3291 |
| 2016/0225302 | A1 * | 8/2016 | Shin | G09G 3/2003 |
| 2016/0284297 | A1 * | 9/2016 | Cheng | G09G 3/3648 |
| 2016/0314757 | A1 * | 10/2016 | Sung | G06F 1/3234 |
| 2017/0108970 | A1 * | 4/2017 | Kim | G09G 3/2092 |
| 2017/0168635 | A1 * | 6/2017 | Xiang | G09G 3/2096 |
| 2017/0169753 | A1 * | 6/2017 | Hao | G09G 3/3607 |
| 2017/0256198 | A1 * | 9/2017 | Hwang | G09G 3/3266 |
| 2018/0013085 | A1 * | 1/2018 | Shin | G09G 3/3291 |
| 2018/0033374 | A1 * | 2/2018 | Jeong | G09G 3/3618 |
| 2018/0040274 | A1 * | 2/2018 | Kurokawa | G09G 3/3275 |
| 2018/0061328 | A1 * | 3/2018 | Kishi | G09G 3/3225 |

(Continued)

*Primary Examiner* — Vinh T Lam
(74) *Attorney, Agent, or Firm* — JCIPRNET

(57) ABSTRACT

An electronic device for driving a display panel and an operation method thereof are provided. The electronic device includes a first input terminal, a first circuit and a second circuit. The first input terminal receives a first sensing signal from a first sensing line of the sensing lines of the display panel. The first circuit generates a first signal according to the first sensing signal and provides a processing circuit with the first signal during a pre-processing period. The second circuit generates a second signal according to the first sensing signal and provides the processing circuit with the second signal during a normal processing period after the pre-processing period.

13 Claims, 9 Drawing Sheets

(56) References Cited

U.S. PATENT DOCUMENTS

| | | | | |
|---|---|---|---|---|
| 2018/0096645 | A1* | 4/2018 | Lee | G09G 3/20 |
| 2018/0122294 | A1* | 5/2018 | Do | G09G 3/3225 |
| 2018/0122305 | A1* | 5/2018 | An | G09G 3/3275 |
| 2018/0190191 | A1* | 7/2018 | Zhai | G09G 3/3233 |
| 2018/0190192 | A1* | 7/2018 | Kwon | G09G 3/3233 |
| 2018/0190207 | A1* | 7/2018 | Hwang | G09G 3/3233 |
| 2018/0348944 | A1* | 12/2018 | Lu | G06F 3/04142 |

* cited by examiner

ELECTRONIC DEVICE FOR DRIVING DISPLAY PANEL AND OPERATION METHOD THEREOF

CROSS-REFERENCE TO RELATED APPLICATION

This application is a continuation application of and claims the priority benefit of a prior application Ser. No. 15/976,830 filed on May 10, 2018. This application claims the priority benefit of U.S. provisional application Ser. No. 62/580,991, filed on Nov. 2, 2017. The entirety of the above-mentioned patent application is hereby incorporated by reference herein and made a part of this specification.

BACKGROUND

Field of the Invention

The invention relates to an electronic device. More particularly, the invention relates to an electronic device for driving a display panel and an operating method thereof.

Description of Related Art

Based on matching factors and/or based on process factors, dummy circuits are generally added next to function circuits in a circuit layout. The dummy circuits and the function circuits have the same circuit structure. In order to prevent uncertainty of voltages of the dummy circuits, input terminals of the dummy circuits are provided with a fixed voltage (e.g., a ground voltage). Based on the conventional technique, a considerable voltage difference may exist between output voltages of the dummy circuits and output voltages of the function circuits.

SUMMARY

The invention provides an electronic device for driving a display panel and an operating method thereof capable of diminishing a difference between sensing results of sensing circuits and dummy sensing results of dummy sensing circuits.

According to an embodiment of the invention, an electronic device capable of driving a display panel having a plurality of sensing lines is provided. The electronic device includes a first input terminal, a first circuit, and a second circuit. The first input terminal is configured to receive a first sensing signal from a first sensing line of the sensing lines of the display panel. The first circuit is configured to generate a first signal according to the first sensing signal and provide a processing circuit with the first signal during a pre-processing period. The second circuit is configured to generate a second signal according to the first sensing signal and provide the processing circuit with the second signal during a normal processing period after the pre-processing period.

According to an embodiment of the invention, an electronic device capable of driving a display panel having a plurality of sensing lines is provided. The electronic device includes a first number of input terminals, a processing circuit, a second number of one or more dummy sensing circuits, and a third number of sensing circuits. The input terminals are configured to receive a plurality of sensing signals from the sensing lines of the display panel, respectively, wherein the first number is equal to a total number of the sensing lines. Each of the one or more dummy sensing circuits is coupled between one or more corresponding ones of the input terminals and the processing circuit. The second number is less than the first number. Each of the sensing circuits is coupled between a corresponding one of the first number of input terminals and the processing circuit, and the third number is equal to the first number.

According to an embodiment of the invention, an operation method of an electronic device for driving a display panel including a plurality of sensing lines is provided. The operation method includes: providing a processing circuit with a first signal in a first period according to at least one sensing signal received from at least one of the sensing lines; providing a processing circuit with a second signal in a second period different from the first period according to a sensing signal received from the at least one of the sensing lines.

To sum up, the at least one sensing circuit of the embodiments of the invention senses the at least one sensing line of the display panel, and the at least one dummy sensing circuit senses the at least one dummy signal, wherein the at least one dummy signal is related to the part of or the all of signals of the sensing lines of the display panel. Because the at least one dummy signal is related to the signals of the sensing lines, the difference between the at least one sensing result of the at least one sensing circuit and the at least one dummy sensing result of the at least one dummy sensing circuit can be effectively diminished.

To make the above features and advantages of the invention more comprehensible, embodiments accompanied with drawings are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
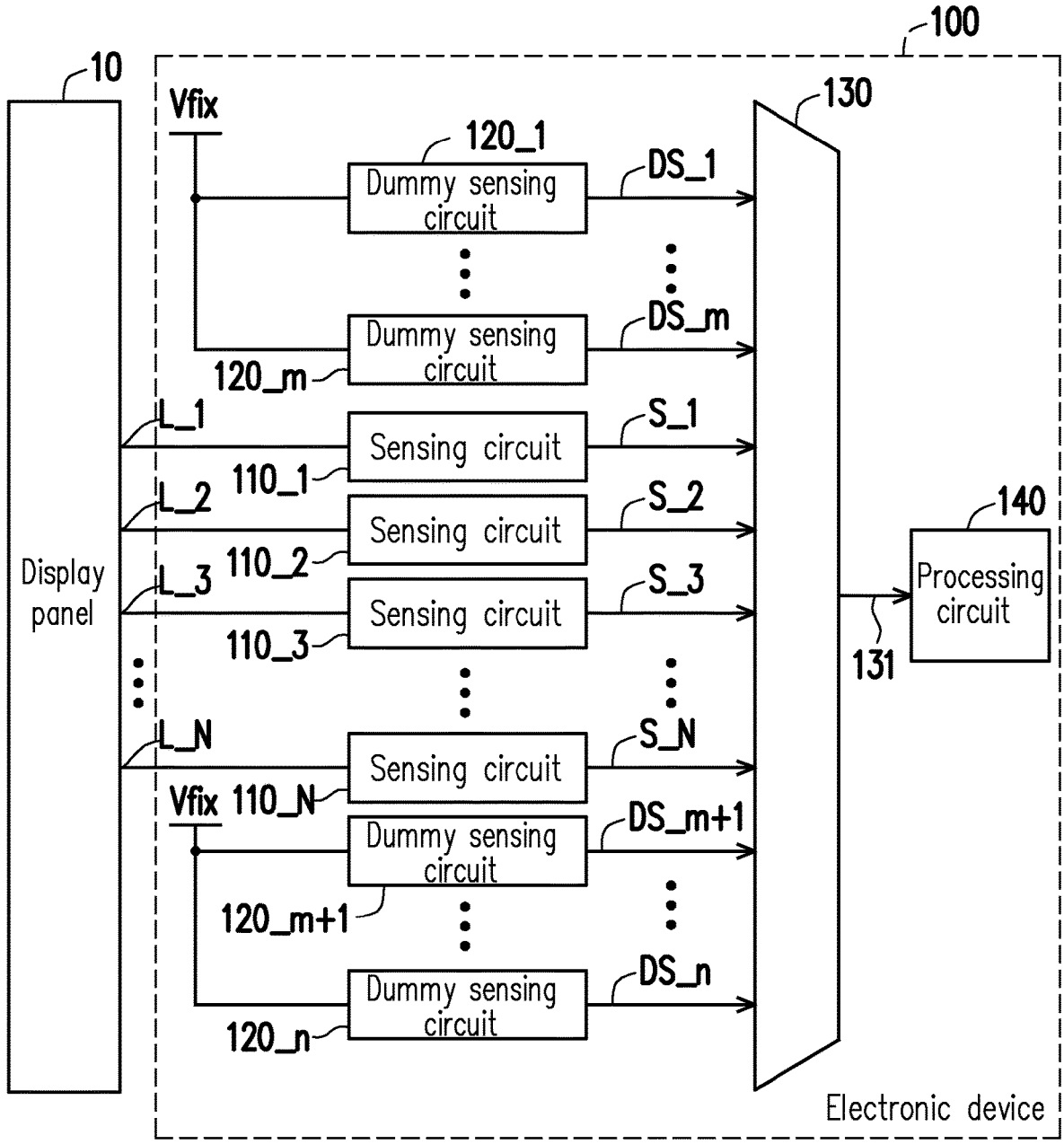
FIG. 1 is a schematic circuit block diagram illustrating an electronic device capable of driving a display panel.

The term "couple (or connect)" herein (including the claims) are used broadly and encompass direct and indirect connection or coupling means. For example, if the disclosure describes a first apparatus being coupled (or connected) to a second apparatus, then it should be interpreted that the first apparatus can be directly connected to the second apparatus, or the first apparatus can be indirectly connected to the second apparatus through other devices or by a certain coupling means. Moreover, elements/components/steps with same reference numerals represent same or similar parts in the drawings and embodiments.

Elements/components/notations with the same reference numerals in different embodiments may be referenced to the related description.

FIG. 1 is a schematic circuit block diagram illustrating an electronic device 100 capable of driving a display panel 10 having a plurality of sensing lines. The display panel 10 may be a light emitting diode (LED) display panel such as an organic LED (OLED) display panel or other display panels. In some embodiments, the display panel 10 may be a conventional display panel and thus, will not be repeatedly described. Based on a design requirement, the electronic device 100 may be implemented as a display driving device including a source driver, a timing controller and/or other circuits/elements.

The electronic device 100 includes a plurality of sensing circuits, for example, sensing circuits 110_1, 110_2, 110_3, . . . and 110_N. Therein, N is an integer determined based on a design requirement. Input terminals of the sensing circuits 110_1 to 110_N can be respectively coupled to different sensing lines L_1, L_2, L_3, . . . L_N of the display panel 10 in a one-to-one manner. The sensing circuits 110_1 to 110_N sense the sensing lines L_1 to L_N, so as to respectively output sensing results S_1, S_2, S_3, . . . and S_N.

The electron device 100 further includes a plurality of dummy sensing circuits, for example, dummy sensing circuits 120_1 to 120_*m* and 120_*m*+1 to 120_*n*. Therein, m and n are integers determined based on a design requirement. Based on matching factors and/or based on process factors, the dummy sensing circuits 120_1 to 120_*m* may be placed at the sensing circuits 110_1 to 110_N, as illustrated in FIG. 1. In order to prevent uncertainty of voltages of the dummy sensing circuits 120_1 to 120_*n*, input terminals of the dummy sensing circuits 120_1 to 120_*n* are coupled to a voltage Vfix, so as to output dummy sensing results DS_1 to DS_m and dummy output sensing results DS_m+1 to DS_n. A level of the fixed voltage Vfix may be determined based on a design requirement. For example, the level of the fixed voltage Vfix may be a ground voltage level. Anyway, the fixed voltage Vfix is not related to (independent of) the signals of the sensing lines L_1 to L_N of the display panel 10.

The electronic apparatus 100 further includes a multiplexer circuit 130 and a processing circuit 140. The multiplexer circuit 130 is coupled to the dummy sensing circuits 120_1 to 120_*n*, so as to receive the dummy sensing results DS_1 to DS_n. The multiplexer circuit 130 is further coupled to the sensing circuits 110_1 to 110_N, so as to receive the sensing results S_1 to S_N. The multiplexer circuit 130 time-divisionally outputs the dummy sensing results DS_1 to DS_n and the sensing results S_1 to S_N from an output terminal of the multiplexer circuit 130. Based on a design requirement, the multiplexer circuit 130 may be a conventional multiplexer or other router circuits. The processing circuit 140 is coupled to the output terminal of the multiplexer circuit 130, so as to time-divisionally receive and process the dummy sensing results DS_1 to DS_n and the sensing results S_1 to S_N. Based on a design requirement, the processing circuit 140 may include an analog-digital converter (ADC), thereby converting an output signal 131 output by the multiplexer circuit 130 into digital data. The processing circuit 140 may be a conventional processor or other processing circuits and thus, will not be repeatedly described.

Figure 2:
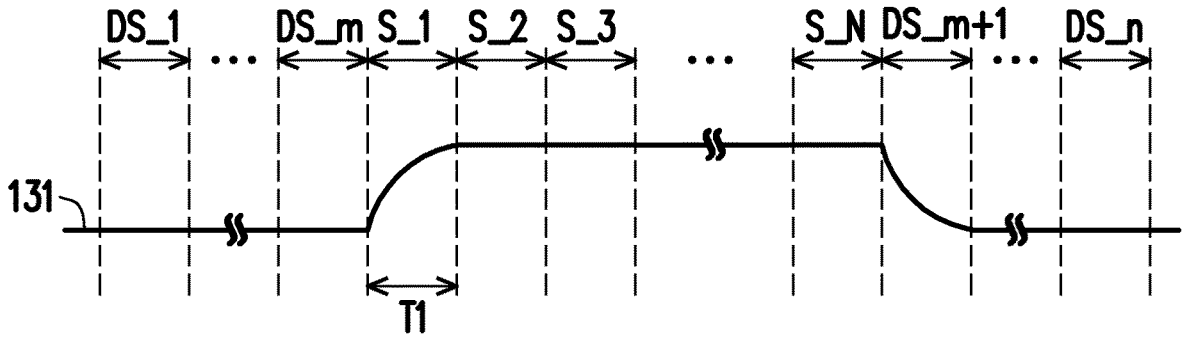
FIG. 2 is a schematic waveform diagram illustrating the output signal of the multiplexer circuit depicted in FIG. 1.

FIG. 2 is a schematic waveform diagram illustrating the output signal 131 of the multiplexer circuit 130 depicted in FIG. 1. In FIG. 2, the horizontal axis represents the time, and the vertical axis represents a voltage (or a current). The multiplexer circuit 130 time-divisionally outputs the dummy sensing results DS_1 to DS_m, the sensing results S_1 to S_N and the dummy sensing results DS_m+1 to DS_n from the output terminal of the multiplexer circuit 130, which becomes the output signal 131 depicted in FIG. 2. Because the fixed voltage Vfix is not related to (independent of) the signals of the sensing lines L_1 to L_N of the display panel 10, a considerable voltage difference exists between the dummy sensing results DS_1 to DS_n and the sensing results S_1 to S_N. Therefore, a state transition occurs to the output signal 131 at a time T1, i.e., a level of the output signal 131 is significantly pulled up from a level of the dummy sensing result DS_m to a level of the sensing result S_1. In an unpreferable state transition, a signal requires a certain time to reach a steady state, as illustrated in FIG. 2. Thus, the output signal 131 received by the processing circuit 140 at the time T1 has an error (which does not have the level of the sensing result S_1).

Figure 3:
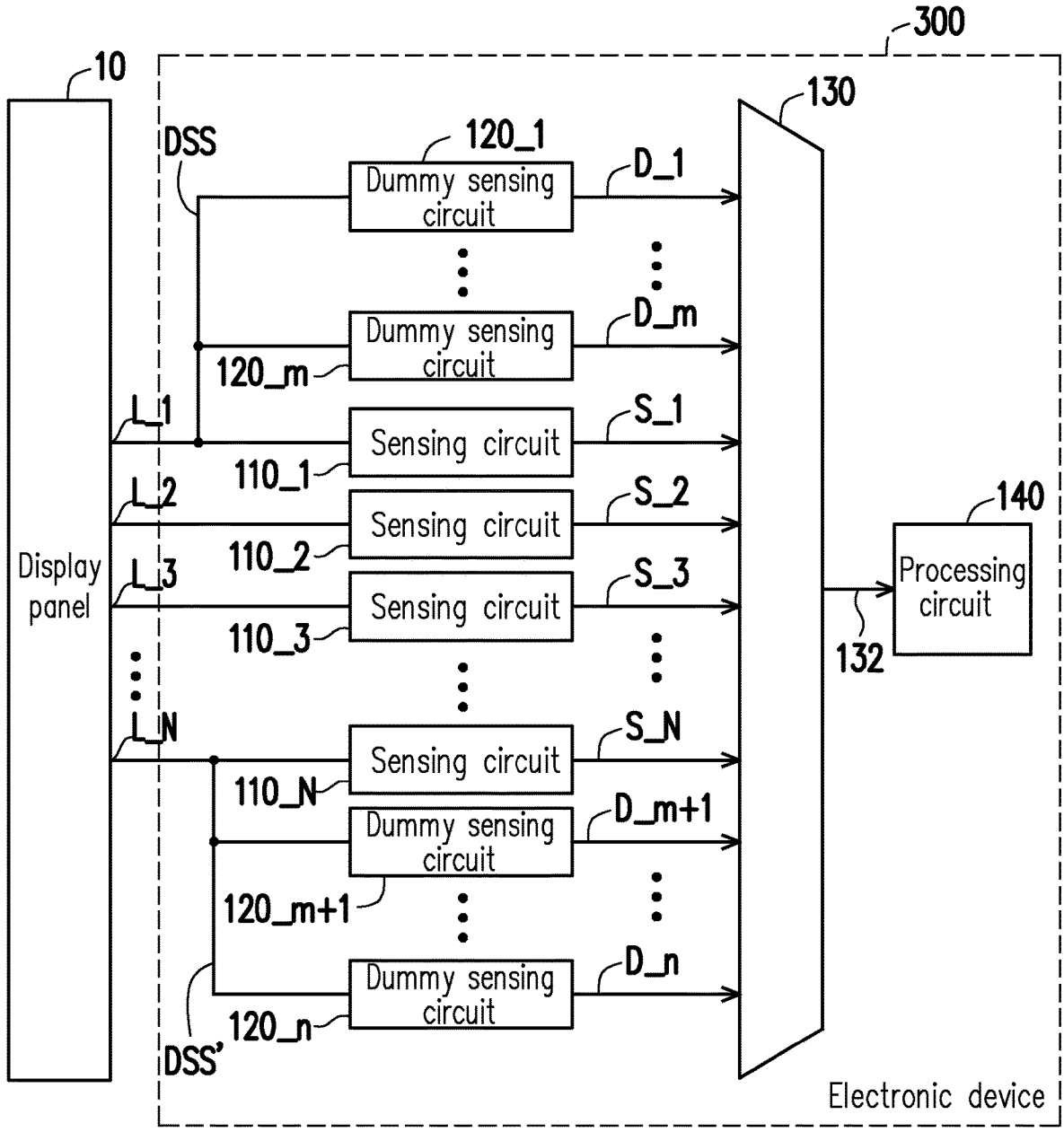
FIG. 3 is a schematic circuit block diagram illustrating an electronic device capable of driving the display panel according to an embodiment of the invention.

FIG. 3 is a schematic circuit block diagram illustrating an electronic device 300 capable of driving the display panel 10 having a plurality of sensing lines according to an embodiment of the invention. The display panel 10 illustrated in FIG. 3 may refer to the description related to FIG. 1 and thus, will not be repeated. Based on a design requirement, the electronic device 300 may be implemented as a display driving device including a source driver, a timing controller, and/or other circuits/elements. The electronic device 300 includes a first input terminal configured to receive a first sensing signal from a first sensing line (e.g. L_1 but not limited thereto) of the sensing lines of the display panel 10. A first circuit generates a first signal according to the first sensing signal. The first circuit may, for example, include the dummy sensing circuit 120_1. The first circuit may further include the dummy signal generation circuit 750. The first circuit provides a processing circuit 140 with the first signal during a pre-processing period. A second circuit generates a second signal according to the first sensing signal. The second circuit provides the processing circuit 140 with the second signal during a normal processing period after the pre-processing period.

In the embodiment illustrated in FIG. 3, the electronic device 300 includes one or more sensing circuits, for example, the sensing circuits 110_1, 110_2, 110_3, . . . and 110_N as illustrated in FIG. 3. The number N of the sensing circuits 110_1 to 110_N may be determined based on a design requirement. The sensing circuits 110_1 to 110_N may be respectively coupled to different sensing lines L_1 to L_N of the display panel 10 in a one-to-one manner. The sensing circuits 110_1 to 110_N may sense the sensing lines L_1 to L_N, so as to respectively output sensing results S_1, S_2, S_3, . . . and S_N. The sensing circuits 110_1 to 110_N illustrated in FIG. 3 may refer to the description related to FIG. 1 and thus, will not be repeated.

The electronic device 300 further includes one or more dummy sensing circuits, for example, dummy sensing circuits 120_1 to 120_*m* and 120_*m*+1 to 120_*n*. Each of the numbers n, m, (n-m) of the sensing circuits 120_1 to 120_*n* may be determined based on a design requirement and the number m may be equal to or unequal to the number (n-m). The dummy sensing circuits 120_1 to 120_*m* may be (directly or indirectly) coupled to one or more sensing lines L_p1 to L_p2 respectively or collectively, wherein p1 and p2 are non-zero integers (for example, p1=p2=1). Similarly, the dummy sensing circuits 120_*m*+1 to 120_n may be (directly or indirectly) coupled to one or more sensing lines L_q1 to L_q2 respectively or collectively, wherein q1 and q2 are non-zero integers (for example, q1=q2=N). This means that different dummy sensing circuits can be coupled to the same or different dummy sensing circuits. In other words, the number m or (n−m) of the dummy sensing circuits on each side may be equal or unequal to the number (p1−p2+1) or (q1−q2+1) of sensing lines among the sensing circuit 120_1-120_N. The dummy sensing circuits 120_1 to 120_*n* may sense one or more dummy signals, in a specific example as shown, dummy signals DSS and DSS'. The dummy sensing circuits 120_1 to 120_*n* may output dummy sensing results D_1 to D_m and D_m+1 to D_n related to the dummy signals. The dummy sensing circuits 120_1 to 120_*n* illustrated in FIG. 3 may refer to the description related to FIG. 1 and thus, will not be repeated. Being different from the embodiment illustrated in FIG. 1, input terminals of the dummy sensing circuits 120_1 to 120_*n* illustrated in FIG. 3 receive the dummy signals DSS and DSS' (instead of the fixed voltage Vfix).

The dummy signals DSS and DSS' are not fixed voltages. The dummy signals DSS and DSS' are related to a part of or all of signals of the sensing lines L_1 to L_N of the display panel 10. For example, the dummy signal DSS may be a signal of one of the sensing lines L_1 to L_N of the display panel 10, and the dummy signal DSS' may be a signal of another one of the sensing lines L_1 to L_N of the display panel 10. In the embodiment illustrated in FIG. 3, the dummy sensing circuits 120_1 to 120_*m* are connected to one of the sensing lines L_1 to L_N of the display panel 10, so as to receive a signal of the one of the sensing lines L_1 to L_N from the one of the sensing lines L_1 to L_N, which serves as the dummy signal DSS. The dummy sensing circuits 120_*m*+1 to 120_*n* are connected to another one of the sensing lines L_1 to L_N of the display panel 10, so as to receive a signal of aforementioned another one of the sensing lines L_1 to L_N from the sensing line to serve as the dummy signal DSS'.

The electronic apparatus 300 further includes one or more multiplexer circuits (one multiplexer 130 is shown for example) and a processing circuit 140. The multiplexer circuit 130 is coupled to the dummy sensing circuits 120_1 to 120_*n*, so as to receive dummy sensing results D_1 to D_n. The multiplexer circuit 130 is coupled to the sensing circuits 110_1 to 110_N, so as to receive sensing results S_1 to S_N. The multiplexer circuit 130 time-divisionally outputs the dummy sensing results D_1 to D_n and the sensing results S_1 to S_N from the output terminal of the multiplexer circuit 130, which become an output signal 132. The processing circuit 140 is coupled to the output terminal of the multiplexer circuit 130, so as to time-divisionally receive the dummy sensing results D_1 to D_n and the sensing results S_1 to S_N. The multiplexer circuit 130 and the processing circuit 140 illustrated in FIG. 3 may refer to the description related to FIG. 1 and thus, will not be repeated.

Figure 4:
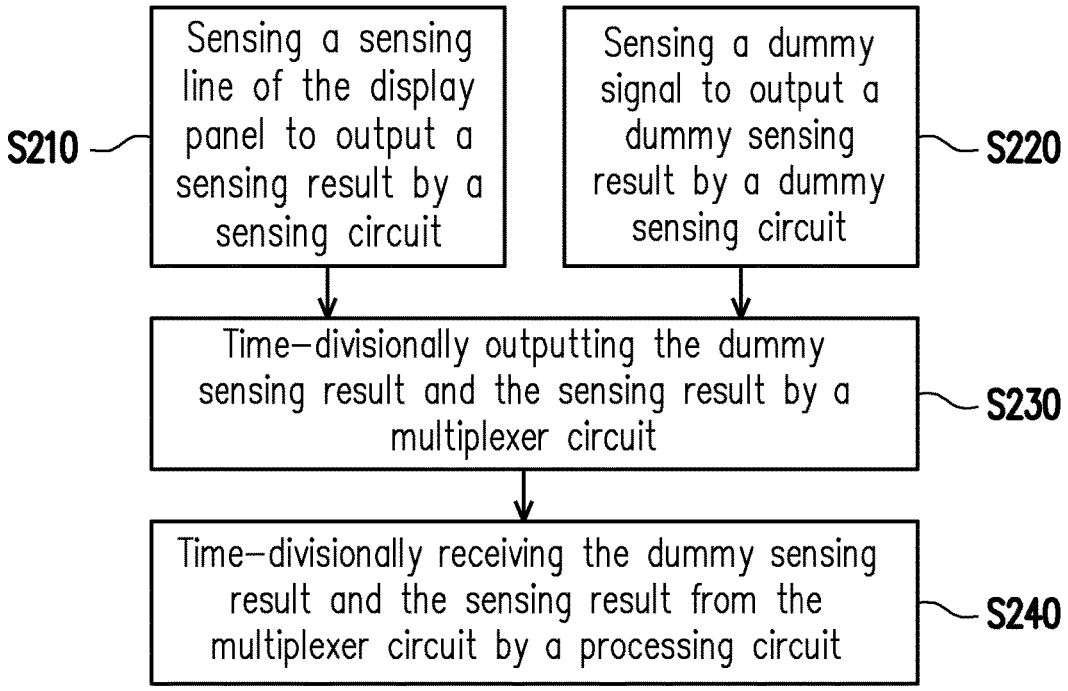
FIG. 4 is a flowchart illustrating an operating method of an electronic device for driving a display panel according to an embodiment of the invention.

FIG. 4 is a flowchart illustrating an operating method of an electronic device for driving a display panel according to an embodiment of the invention. Referring to FIG. 3 and FIG. 4, in step S210, the sensing circuits 110_1 to 110_N may sense different sensing lines L_1 to L_N of the display panel 10, so as to output the sensing results S_1 to S_N. In step S220, the dummy sensing circuits 120_1 to 120_*n* may sense the dummy signals DSS and DSS', so as to output the dummy sensing results D_1 to D_n. The dummy signals DSS and DSS' are related to a part or all of the signals of the sensing lines L_1 to L_N of the display panel 10. In step S230, the multiplexer circuit 130 time-divisionally outputs the dummy sensing results D_1 to D_n and the sensing results S_1 to S_N from the output terminal of the multiplexer circuit 130. In step S240, the processing circuit 140 time-divisionally receives the dummy sensing results D_1 to D_n and the sensing results S_1 to S_N from the output terminal of the multiplexer circuit 130.

Figure 5:
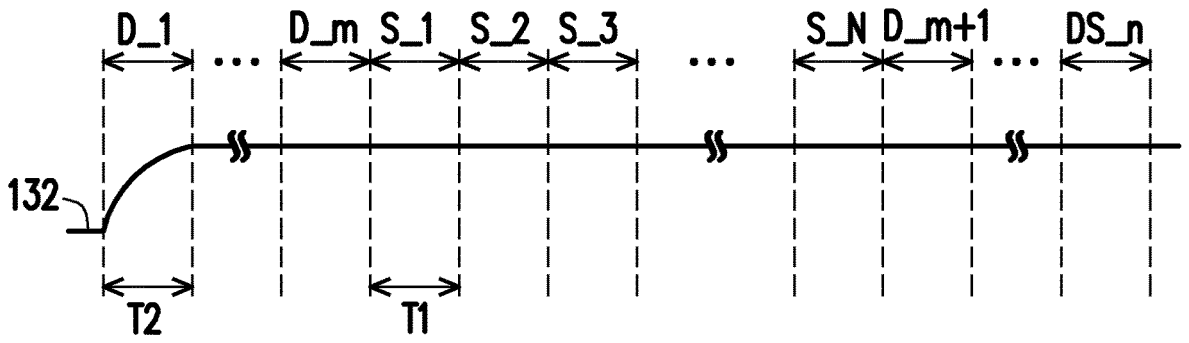
FIG. 5 is a schematic waveform diagram illustrating the output signal of the multiplexer circuit depicted in FIG. 3 according to an embodiment of the invention.

FIG. 5 is a schematic waveform diagram illustrating the output signal 132 of the multiplexer circuit 130 depicted in FIG. 3 according to an embodiment of the invention. In FIG. 5, the horizontal axis represents the time, and the vertical axis represents a voltage (or a current). The multiplexer circuit 130 time-divisionally outputs the dummy sensing results D_1 to D_m, the sensing results S_1 to S_N and the dummy sensing results D_m+1 to D_n from the output terminal of the multiplexer circuit 130, which become the output signal 132 illustrated in FIG. 5. Because the dummy signals DSS and DSS' are related to the signals of the sensing lines of the display panel 10, a voltage difference (or a current difference) between the dummy sensing results D_1 to D_n and the sensing results S_1 to S_N may be effectively diminished. Namely, a change of a level of the output signal 132 at the time T1 (which is switched from a level of the dummy sensing result D_m to a level of the sensing result S_1) can be sufficiently small to be ignored (or to be tolerated). Compared to FIG. 2, a time point at which a state transition occurs to the output signal 132 is advanced from the time T1 to a time T2 in FIG. 5. FIG. 5 illustrates that the state transition occurs to the output signal 132 at the time T2, the dummy sensing result D_1 is generally ignored. Thus, an error of the output signal 132 existing at the time T2 cannot influence a sensing operation performed on the display panel 10 by the electronic device 300.

Figure 6:
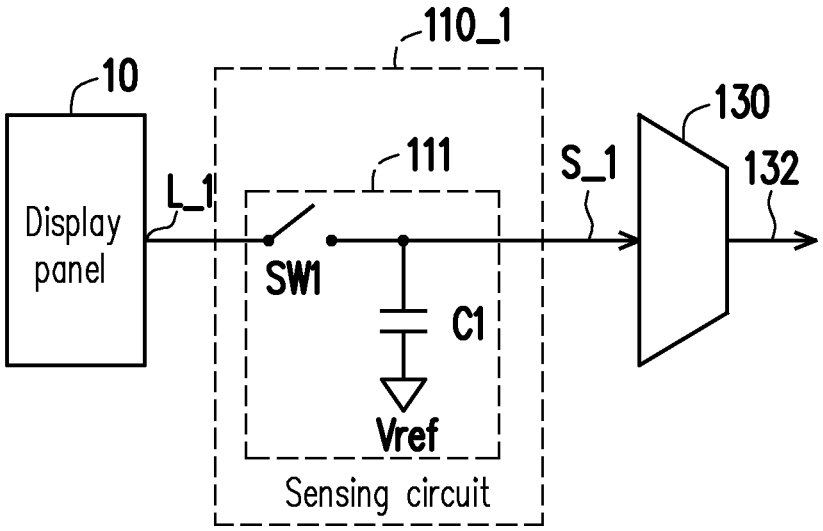
FIG. 6 is a schematic circuit block diagram illustrating the sensing circuit depicted in FIG. 3 according to an embodiment of the invention.

FIG. 6 is a schematic circuit block diagram illustrating the sensing circuit 110_1 depicted in FIG. 3 according to an embodiment of the invention. The rest of the sensing circuits 110_2 to 110_N illustrated in FIG. 3 may be inferred with reference to the description related to the sensing circuit 110_1 and thus, will not be repeated. In the embodiment illustrated in FIG. 6, the sensing circuit 110_1 includes a sampling and holding circuit 111. The sampling and holding circuit 111 may include a switching circuit SW1 and a capacitor C1. The switching circuit SW1 has a first terminal configured to be coupled to one of the sensing lines L_1 to L_N of the display panel 10 and a second terminal coupled to the multiplexer circuit 130 to provide the sensing result S_1. A first terminal of the capacitor C1 is coupled to the second terminal of the switching circuit SW1 and a second terminal coupled to a reference voltage Vref. A level of the reference voltage Vref may be determined based on a design requirement. In a sampling period, the switching circuit SW1 is turned on, and thus, the capacitor C1 may sample a signal of one of the sensing lines L_1 to L_N of the display panel 10 through the switching circuit SW1. In a holding period, the switching circuit SW1 is turned off, and thus, the sampled signal of the sensing line may be held in the capacitor C1. The sampled signal of the sensing line held in the capacitor C1 may serve as the sensing result S_1. It is noted that other available structures of sampling and holding circuit or circuits capable of sensing/transmitting signals from display panel to the processing circuit can be utilized in the sensing circuit according to design requirements.

Figure 7:
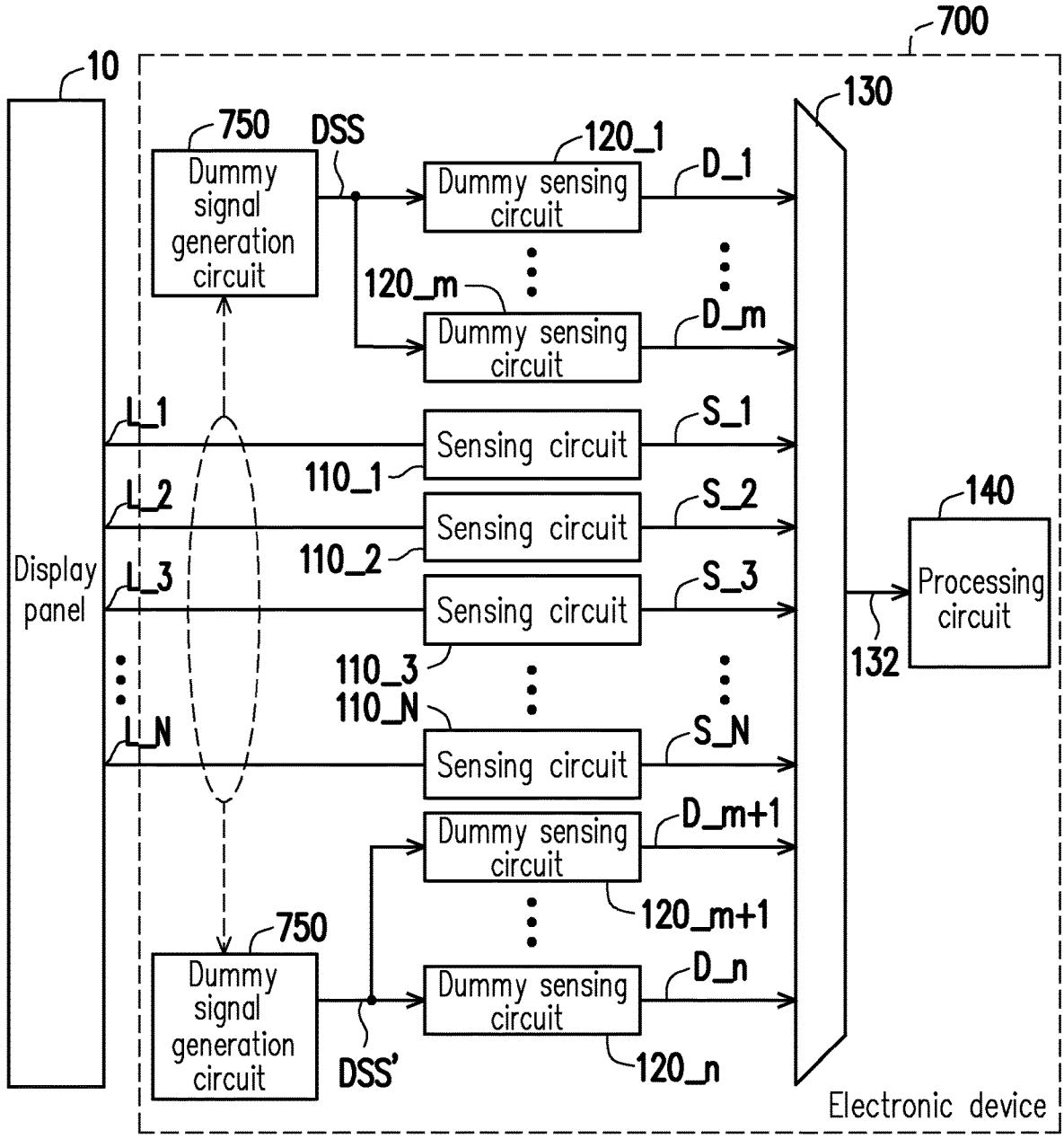
FIG. 7 is a schematic circuit block diagram illustrating an electronic device capable of driving a display panel according to another embodiment of the invention.

FIG. 7 is a schematic circuit block diagram illustrating an electronic device 700 capable of driving the display panel 10 according to an embodiment of the invention. Based on a design requirement, the electronic device 700 may be implemented as a display driving device including a source driver, a timing controller, and/or other circuits/elements. The electronic device 700 includes sensing circuits 110_1 to 110_N, dummy sensing circuits 120_1 to 120_*n*, a multiplexer circuit 130, a processing circuit 140 and a dummy signal generation circuit 750. The display panel 10 illustrated in FIG. 7 may refer to the descriptions related to FIG. 1 and FIG. 3 and thus, will not be repeated. The sensing circuits 110_1 to 110_N, the dummy sensing circuits 120_1 to 120_*n*, the multiplexer circuit 130 and the processing circuit 140 may refer to the descriptions related to FIG. 3 through FIG. 6 and thus, will not be repeated.

The dummy signal generation circuit 750 is coupled between a part or all of the sensing lines L_1 to L_N of the display panel 10 and the dummy sensing circuits 120_1 to 120_*n*, as illustrated in FIG. 7. The dummy signal generation circuit 750 may generate a part or both of the dummy signals DSS and DSS' related to the part or the all of signals and provide the dummy signals DSS and DSS' to the dummy sensing circuits 120_1 to 120_*n*. In some embodiments, the dummy signals DSS and DSS' are related to a voltage (or a current) of one of the sensing lines L_1 to L_N of the display panel 10. In some other embodiments, the dummy signals DSS and DSS' are related to a plurality of voltages (or currents) of a plurality of sensing lines among the sensing lines L_1 to L_N of the display panel 10.

Figure 8:
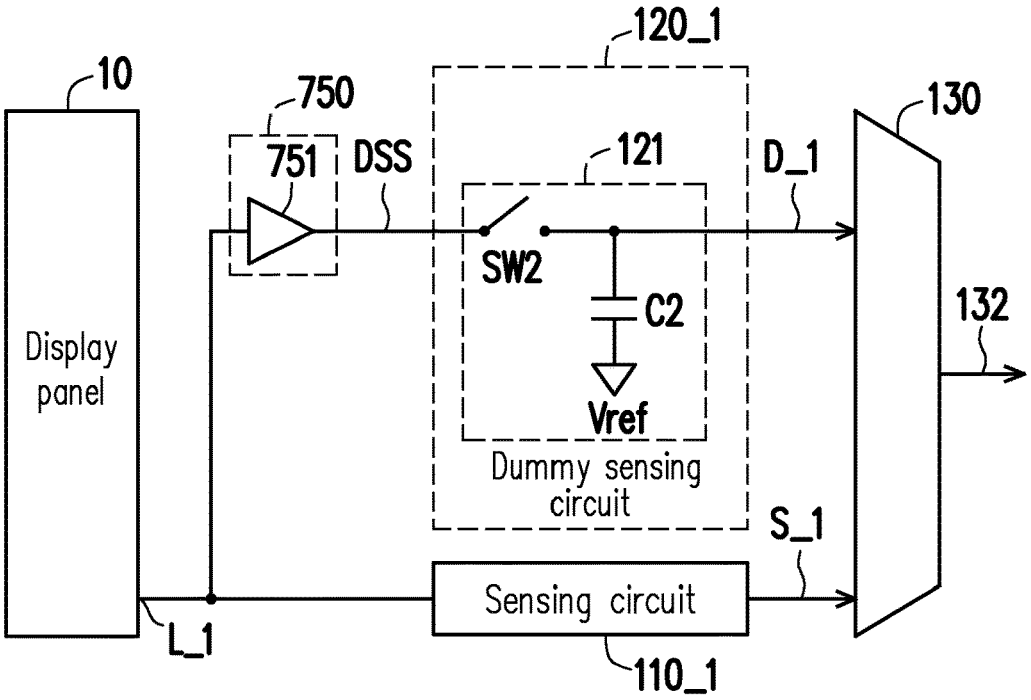
FIG. 8 is a schematic circuit block diagram illustrating the dummy sensing circuit and the dummy signal generation circuit depicted in FIG. 7 according to an embodiment of the invention.

FIG. 8 is a schematic circuit block diagram illustrating the dummy sensing circuit 120_1 and the dummy signal generation circuit 750 depicted in FIG. 7 according to an embodiment of the invention. The rest of the dummy sensing circuits illustrated in FIG. 7 may be inferred with reference to the description related to the sensing circuit 120_1 and thus, will not be repeated. In the embodiment illustrated in FIG. 8, the dummy sensing circuit 120_1 includes a sampling and holding circuit 121. The sampling and holding circuit 121 includes a switching circuit SW2 and a capacitor C2. The switching circuit SW2 has a first terminal configured to be coupled to the dummy signal generation circuit 750 to receive the dummy signal DSS. A second terminal of the switching circuit SW2 is coupled to the multiplexer circuit 130 to provide the dummy sensing result D_1. A first terminal of the capacitor C2 is coupled to the second terminal of the switching circuit SW2, and a second terminal of the capacitor C2 is coupled to a reference voltage Vref. A level of the reference voltage Vref may be determined based on a design requirement. In a sampling period, the switching circuit SW2 is turned on, and thus, the capacitor C2 may sample the dummy signal DSS generated by the dummy signal generation circuit 750 through the switching circuit SW2. In a holding period, the switching circuit SW2 is turned off, and thus, the dummy signal DSS may be held in the capacitor C2. The dummy signal DSS held in the capacitor C2 may serve as the dummy sensing result D_1.

In the embodiment illustrated in FIG. 8, the dummy signal generation circuit 750 includes a buffer circuit 751. An input terminal of the buffer circuit 751 is coupled to at least one of the sensing lines L_1 to L_N of the display panel 10. An output terminal of the buffer circuit 751 is coupled to the dummy sensing circuit 120_1 to provide the dummy signals DSS related to the sensing line of the display panel 10. In the embodiment illustrated in FIG. 8, the dummy signal DSS is related to a voltage (or a current) of one of the sensing lines L_1 to L_N of the display panel 10. The aforementioned sensing line (which is the sensing line connected to the buffer circuit 751) is the sensing line which is the most adjacent to the dummy sensing circuit 120_1.

Figure 9:
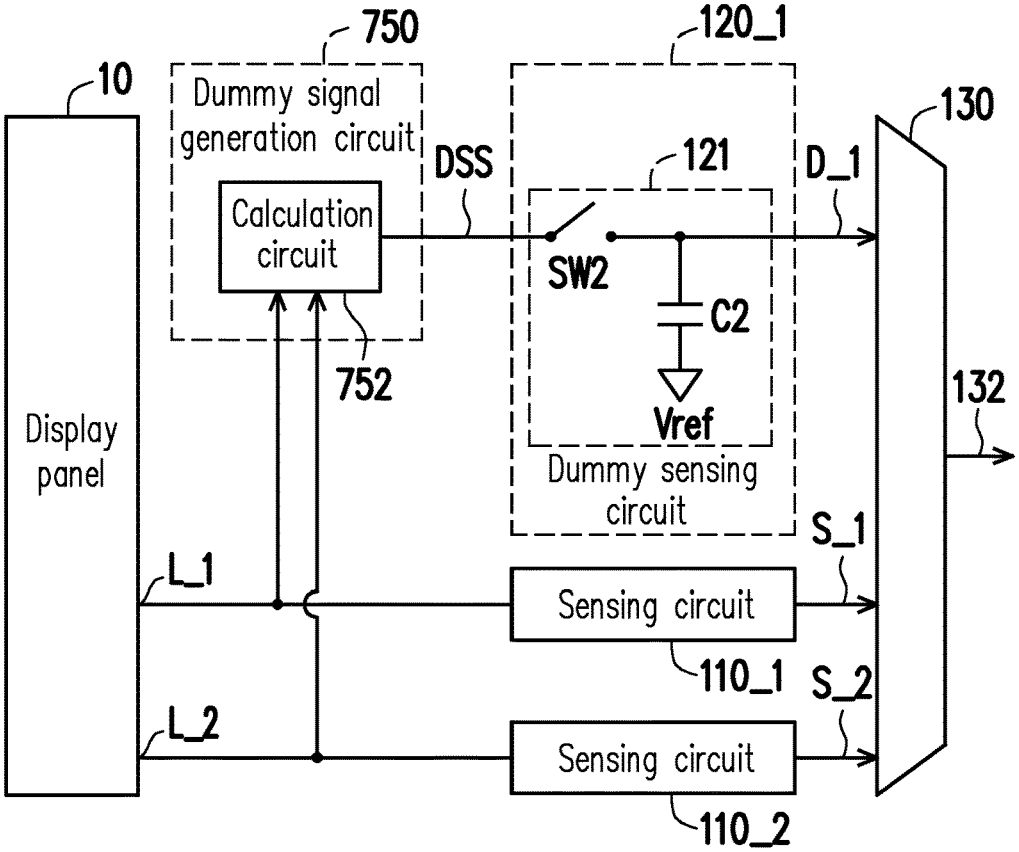
FIG. 9 is a schematic circuit block diagram illustrating the dummy signal generation circuit depicted in FIG. 7 according to another embodiment of the invention.

FIG. 9 is a schematic circuit block diagram illustrating the dummy signal generation circuit 750 depicted in FIG. 7 according to another embodiment of the invention. The rest of the dummy sensing circuits illustrated in FIG. 7 may be inferred with reference to the description related to the dummy sensing circuit 120_1 and thus, will not be repeated. The sensing circuit 120_1 illustrated in FIG. 9 may refer to the description related to FIG. 8 and thus, will not be repeated. The dummy signal generation circuit 750 illustrated in FIG. 9 includes a calculation circuit 752. The calculation circuit 752 has at least one input terminal (directly or indirectly) coupled to at least one of the sensing lines L_1 to L_N (referred to as the coupled sensing line) of the display panel 10. In the embodiment illustrated in FIG. 9, an input terminal of the calculation circuit 752 and an input terminal of the sensing circuit 110_1 are jointly coupled to one of the sensing lines L_1 to L_N of the display panel 10, and another input terminal of the calculation circuit 752 and an input terminal of the sensing circuit 110_2 are jointly coupled to another one of the sensing lines L_1 to L_N of the display panel 10. At least one output terminal of the buffer circuit 752 is coupled to the dummy sensing circuit 120_1. The calculation circuit 7520 is configured to calculate the dummy signal DSS according to one or more voltages/currents (shown as one voltage/current for example) of the one or more coupled sensing lines (shown as one coupled sensing line for example).

In the embodiment illustrated in FIG. 9, the dummy signal DSS is related to voltages (or currents) of a plurality of sensing lines among the sensing lines L_1 to L_N of the display panel 10. The coupled sensing lines of the display panel 10 (which are connected to the calculation circuit 752) can be the sensing lines which are the most adjacent to the dummy sensing circuit 120_1. The dummy signal DSS may be related to an average or a weighted value of the voltages (or the currents) of the plurality of coupled sensing lines. Namely, the calculation circuit 752 may sense the voltages (or the currents) of the coupled sensing lines and calculate the average or the weighted value of the voltages (or the currents) of the coupled sensing lines to serve as the dummy signal DSS.

Figure 10:
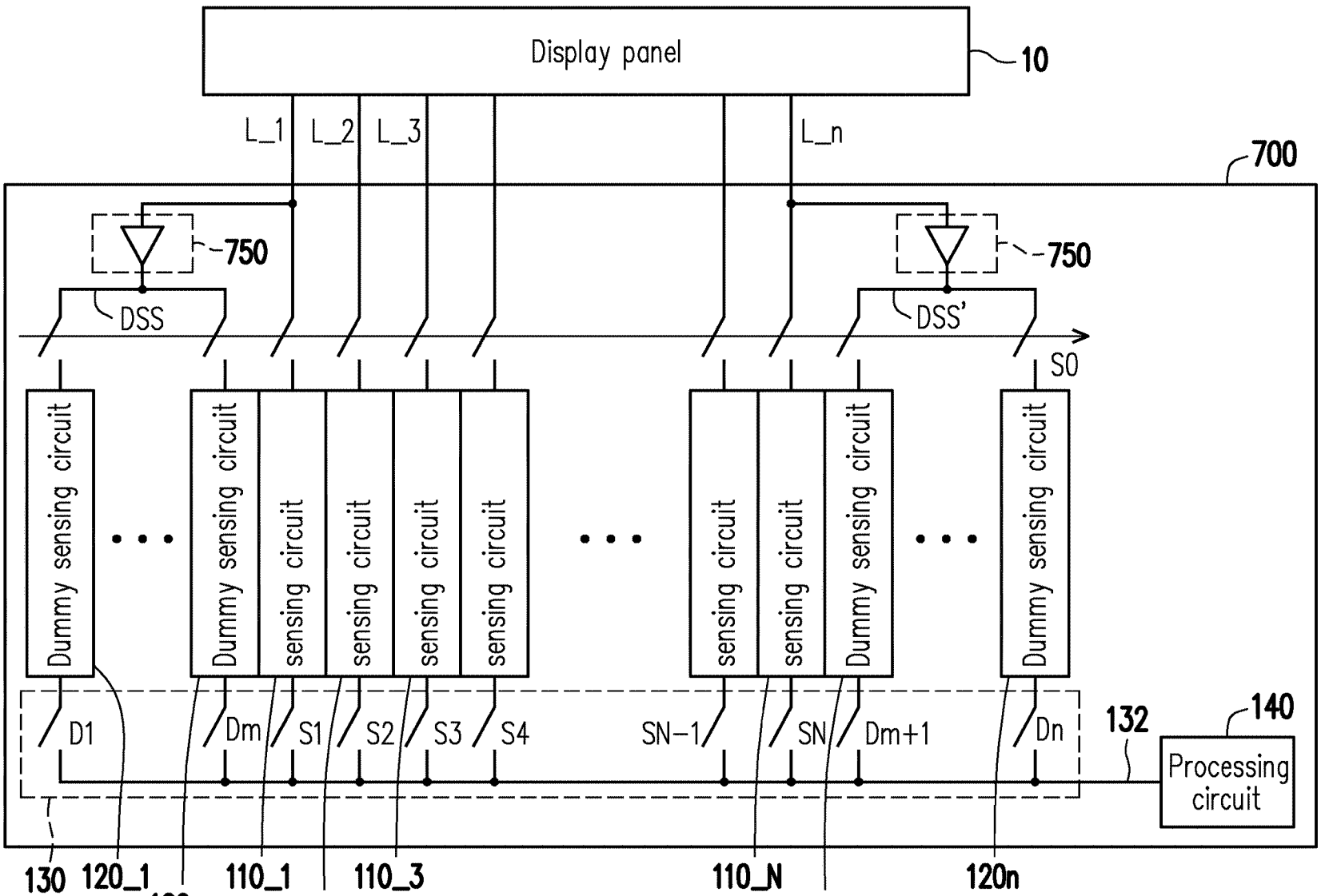
FIG. 10 is a schematic circuit block diagram illustrating the multiplexer circuit and the dummy signal generation circuit depicted in FIG. 7 according to an embodiment of the invention.

FIG. 10 is a schematic circuit block diagram illustrating the multiplexer circuit 130 and the dummy signal generation circuit 750 depicted in FIG. 7 according to an embodiment of the invention. The display panel 10, the electronic device 700, the sensing circuits 110_1 to 110_N, the dummy sensing circuits 120_1 to 120_*n*, the multiplexer circuit 130 and the processing circuit 140 illustrated in FIG. 10 may refer to the description related to FIG. 7, the dummy signal generation circuit 750 illustrated in FIG. 10 may refer to the description related to FIG. 7 and FIG. 8, and thus, will not be repeated. Based on a design requirement, the multiplexer circuit 130 includes a plurality of switches, for example, switches D1, . . . , Dm, S1, S2, S3, S4, . . . , SN−1, SN, Dm+1, . . . , Dn.

Figure 11:
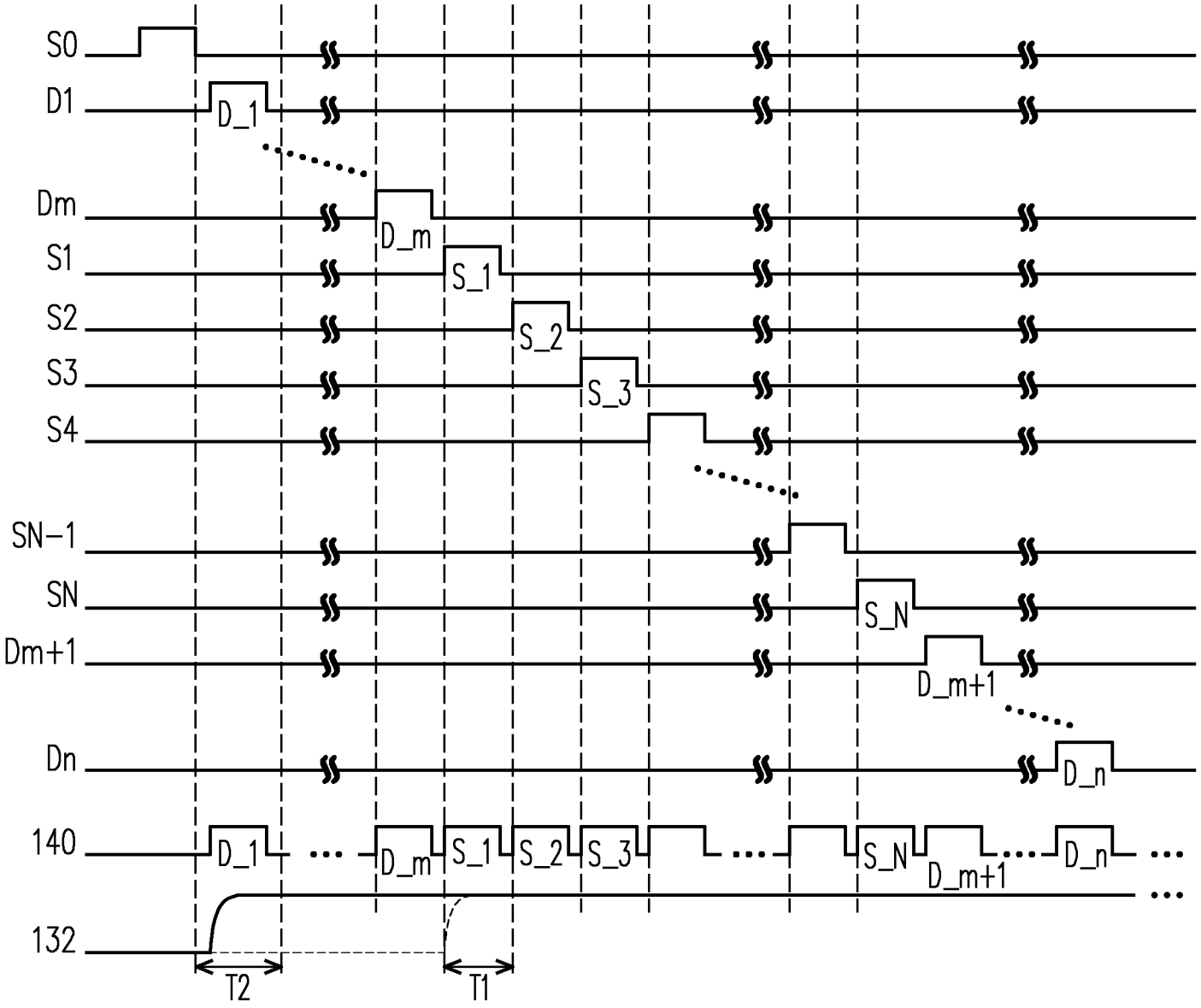
FIG. 11 is a schematic waveform diagram illustrating the signal of the circuit depicted in FIG. 10 according to an embodiment of the invention.

FIG. 11 is a schematic waveform diagram illustrating the signals of the circuit depicted in FIG. 10 according to an embodiment of the invention. In FIG. 11, the horizontal axis represents the time, and the vertical axis represents the level of the signals and On-state of the switches. Referring to FIG. 10 and FIG. 11, the switches D1 to Dm, the switches S1 to SN, and the switches Dm+1 to Dn time-divisionally output the dummy sensing results D_1 to D_m, the sensing results S_1 to S_N and the dummy sensing results D_m+1 to D_n, which become the output signal 132 illustrated in FIG. 11.

A first input terminal of the electronic device 700 is configured to receive a first sensing signal from a first sensing line (e.g. the sensing line L_1 but not limited thereto) of the sensing lines of the display panel 10. A first circuit is configured to generate a first signal according to the first sensing signal. The first circuit may, for example, include the dummy sensing circuit 120_1. The first circuit may further include the dummy signal generation circuit 750. The first circuit provides a processing circuit 140 with the first signal during a pre-processing period (e.g. the time T2). A second circuit (e.g. the sensing circuit 110_1) is configured to generate a second signal according to the first sensing signal. The second circuit provides the processing circuit 140 with the second signal during a normal processing period (e.g. the time T1) after the pre-processing period.

Because the dummy signals DSS and DSS' are related to the signals of the sensing lines of the display panel 10, a voltage difference (or a current difference) between the dummy sensing results D_1 to D_n and the sensing results S_1 to S_N may be effectively diminished. Namely, a change of a level of the output signal 132 at the time T1 (the normal processing period, which is switched from a level of the dummy sensing result D_m to a level of the sensing result S_1) can be sufficiently small to be ignored (or to be tolerated). Compared to FIG. 2, a time point at which a state transition occurs to the output signal 132 is advanced from the time T1 (the normal processing period) to a time T2 (the pre-processing period) in FIG. 11. FIG. 11 illustrates that the state transition occurs to the output signal 132 at the time T2, the dummy sensing result D_1 is generally ignored. Thus, an error of the output signal 132 existing at the time T2 cannot influence a sensing operation performed on the display panel 10 by the electronic device 700 in FIG. 10.

In light of the foregoing, the sensing circuits of the embodiments of the invention can sense the sensing lines of the display panel, and the dummy sensing circuit can sense the dummy signals. The dummy signals are related to the part of or the all of the signals of the sensing lines of the display panel. Because the dummy signals are related to the signals of the sensing lines, the difference between the sensing results of the sensing circuits and the dummy sensing results of the dummy sensing circuits can be effectively diminished or reduced.

Although the invention has been disclosed by the above embodiments, they are not intended to limit the invention. It will be apparent to one of ordinary skill in the art that modifications and variations to the invention may be made without departing from the spirit and scope of the invention. Therefore, the scope of the invention will be defined by the appended claims.

What is claimed is:

1. An electronic device capable of driving a display panel having a plurality of sensing lines, comprising:

a first input terminal, configured to receive a first sensing signal from a first sensing line of the sensing lines of the display panel;

a first circuit, configured to generate a first signal according to the first sensing signal and provide a processing circuit with the first signal through a first signal path during a pre-processing period; and a second circuit, configured to generate a second signal according to the first sensing signal and provide the processing circuit with the second signal through a second signal path different from the first signal path during a normal processing period after the pre-processing period, wherein both the pre-processing period and the normal processing period are included in a sensing period of the display panel.

2. The electronic device according to claim 1, wherein the first signal is used for causing the processing circuit to process the second signal more accurately.

3. The electronic device according to claim 1, wherein the first signal has a signal level in positive correlation with a signal level of the second signal.

4. The electronic device according to claim 1, further comprising:

a second input terminal, configured to receive a second sensing signal from a second sensing lines of the sensing lines of the display panel;

a third circuit, configured to generate a third signal according to the second sensing signal and provide the processing circuit with the third signal during a third period after the normal processing period.

5. The electronic device according to claim 1, wherein the first circuit is configured to generate the first signal according to the first sensing signal and the second sensing signal and provide the processing circuit with the first signal during the pre-processing period.

6. An electronic device capable of driving a display panel having a plurality of sensing lines, comprising:

a first number of input terminals, configured to receive a plurality of sensing signals from the sensing lines of the display panel, respectively, wherein the first number is equal to a total number of the sensing lines;

a processing circuit;

a second number of one or more dummy sensing circuits, each coupled between one or more corresponding ones of the first number of input terminals and the processing circuit, and the second number is less than the first number; and a third number of sensing circuits, each coupled between a corresponding one of the first number of input terminals and the processing circuit, and the third number is equal to the first number.

7. The electronic device according to claim 6, further comprising at least one dummy signal generating circuit, each coupled between one or more corresponding ones of the first number of input terminals and a corresponding one of the second number of one or more dummy sensing circuit and configured to generate a dummy signal according to one or more sensing signals received from the one or more corresponding ones of the first number of input terminals and provide the dummy signal to the corresponding dummy sensing circuit.

8. The electronic device according to claim 6, wherein the second number of the one or more dummy sensing circuits are configured to provide the processing circuit with the one or more first signals during a first period, wherein each of the one or more first signals is generated according to at least one of the sensing signals, and the third number of sensing circuits are configured to generate a plurality of second signals according to the sensing signals and provide the processing circuit with the second signals during a second period after the first period.

9. The electronic device according to claim 6, wherein the second number of the one or more dummy sensing circuits are configured to provide the processing circuit with the one or more first signals, and the one or more first signals are used for causing the processing circuit to process the second signal more accurately.

10. The electronic device according to claim 6, wherein the second number of the one or more dummy sensing circuits are configured to provide the processing circuit with the one or more first signals, and the third number of sensing circuits are configured to provide the processing circuit with a plurality of second signals, wherein each of the one or more first signals has a signal level in positive correlation with a signal level of a corresponding one of the second signals.

11. An operation method of an electronic device for driving a display panel comprising a plurality of sensing lines, comprising:

providing a processing circuit with a first signal in a first period according to at least one sensing signal received from at least one of the sensing lines through a first signal path;

providing a processing circuit with a second signal in a second period different from the first period according to a sensing signal received from the at least one of the sensing lines through a second signal path different from the first signal path, wherein both the first period and the second period are included in a sensing period of the display panel.

12. The operation method according to claim 11, wherein the first signal is used for causing the processing circuit to process the second signal more accurately.

13. The operation method according to claim 11, wherein the first signal has a signal level in positive correlation with a signal level of the second signal.

* * * * *